US005438722A

United States Patent [19]

Jayamanne

[11] Patent Number: 5,438,722

[45] Date of Patent: Aug. 8, 1995

[54] PATIENT TRANSFER CHAIR SYSTEM

[76] Inventor: Don J. Jayamanne, 555 Oak St. #306, Glendale, Calif. 91204

[21] Appl. No.: 262,989

[22] Filed: Jun. 20, 1994

[51] Int. Cl.[6] ..... A61G 7/16

[52] U.S. Cl. ..... 5/618; 5/81.1; 5/425

[58] Field of Search ..... 5/81.1, 618, 425

[56] References Cited

U.S. PATENT DOCUMENTS

| | | | |
|---|---|---|---|
| 2,609,862 | 9/1952 | Pratt | 5/81.1 |
| 3,137,011 | 6/1964 | Fischer . | |
| 3,786,523 | 1/1974 | Sele | 5/81.1 |
| 4,079,990 | 3/1978 | McMunn et al. | 5/81.1 |
| 4,944,056 | 7/1990 | Schroeder et al. . | |
| 4,997,200 | 3/1991 | Earls | 5/81.1 |
| 5,050,899 | 9/1991 | Stensby | 5/81.1 |
| 5,060,960 | 10/1991 | Branscumb et al. . | |
| 5,193,633 | 3/1993 | Ezenwa | 5/81.1 |

*Primary Examiner*—Michael J. Milano
*Attorney, Agent, or Firm*—Merchant, Gould, Smith, Edell, Welter & Schmidt

[57] ABSTRACT

A patient transfer device comprises a cushioned chair with wheels that facilitates patient transfer in and out of a hospital clinical bed. The patient transfer device provides an entirely different method of transferring patients that avoids lifting the total body weight of the patient and that provides the maximum comfort for the patient.

13 Claims, 3 Drawing Sheets

PATIENT TRANSFER CHAIR SYSTEM

BACKGROUND OF THE INVENTION

1. Field of the Invention

This invention relates in general to a patient transfer device, and more specifically, to a patient transfer device comprising a cushioned chair with wheels that facilitates patient transfer in and out of a hospital clinical bed.

2. Description of Related Art

The common practice among nurses in hospitals and long-term nursing care facilities requires two or more nurses to lift a patient in and out of a hospital bed in order to provide the necessary care for one who is disabled and needs total care due to paralysis, old age, fracture, comatose condition, post-surgery or other condition which limits the patient's abilities. Regardless of existing patient transfer devices, nurses in hospitals and long-term care facilities are still manually lifting the patient in and out of bed several times during an eight-hour shift in order to provide such patient care as cleaning after bowel and bladder incontinence while in the chair (the patient must be put back in bed before any such care is attempted). In addition, moving a patient to another location or assisting the patient for therapy under a doctor's orders are some common practices which demand that a patient be transferred in and out of a hospital bed. Moreover, lifting a patient from bed to wheelchair or wheelchair to bed is one of the major causes of work-related injuries among nurses. Many times, lifting such a patient has disabled a nurse permanently. Therefore, regardless of existing transfer devices, patients and nurses continue to suffer from a lack of a proper patient transfer device.

Due to the lack of a proper patient transfer device, some patients in nursing homes sit in a wheelchair in the same position most of the day, unable to express their needs because they are confused or disabled, and their nurses are unable to easily move them back and forth from bed to chair as frequently as necessary when other patients are waiting for attention. This is especially true in working with many patients, as in most convalescent hospitals. Nurses are constantly under time pressure and they are exhausted from lifting patients.

The prior art includes several types of lifters and patient transfer devices to assist nursing care. However, these prior art devices suffer from a number of disadvantages due to lack of proper devices and a practical method for their use in a hospital environment. Thus, existing patient transfer devices are not being used as often as they should be to avoid injuries to hospital workers and to patients.

U.S. Pat. No. 4,944,056, issued Jul. 31, 1990, to Schroeder et al., discloses a complex method and apparatus for transporting a disabled patient from bed to chair and back to bed. This complex device was adapted to engage both ceiling and floor, which is not practical for use in hospitals or the nursing home environment. Although it can raise, lower and carry the patient, using a hoist mounted to the ceiling, it takes up too much space and is time consuming to operate. Moreover, it requires two separate pieces of equipment and is expensive to maintain.

U.S. Pat. No. 3,137,011, issued Jun. 16, 1964, to Fischer, also discloses a complex patient transfer device with three pieces to perform the transfer. It needs a sling on which to suspend the patient, chains to attach the sling to a hoist and a chair on which to place the patient. This method is not only time consuming, as is U.S. Pat. No. 4,944,056 above, but it results in the squeezing and bending of the patient in all directions when he or she is being lifted. Therefore, patients with certain types of fractures and after surgeries are unable to use this type of lifting device. Moreover, it is too large for a hospital's limited space availability, and it is costly to maintain both a wheelchair and a separate patient transfer device.

U.S. Pat. No. 5,060,960, issued Oct. 29, 1991, to Branscumb et al., discloses a wheelchair with a lifting device. However, the wheelchair fails to satisfy many important needs and requirements when assisting total care patients who are paralyzed, comatose, with a fracture or other geriatric complications, especially in a long-term nursing care or hospital environment.

For example, the '960 device is designed with a total of six wheels: two large wheels and four cluster wheels. The large wheels prevent the chair from being set close enough to the bed the space between the bed and the chair is similar to using a regular wheelchair. The hospital environment is not a place to remove and attach wheels or any other parts or keep them handy to use later, especially in long-term care facilities and hospitals where there are many similar wheelchairs, one per patient, sometimes two or three patients per room. It is difficult to maintain, it is inconvenient, time-consuming and requires storage space to have unattached wheels. All of these points limit the use of this chair.

Another problem arises with the '960 device because it has armrests that move to the side, away from the seat panel, but create a difficulty when transferring a total care patient.

Still another problem with the '960 device is that it is designed to move a patient from a seated position to a bedside or for use as a temporary bed facility before transferring a patient back to bed. Typically, the backrest can be removed from the wheelchair frame to permit lowering of the patient's back by releasing a Velcro strip attachment, but it fails to consider some of the difficulties and restrictions, capabilities and safety of some patients who are unable to bend, pull, stretch, strain or lift certain body parts without getting them hurt. Therefore, patients suffering with certain injuries such as to the back, hip, neck, spine and to the limbs are unable to use prior art safely. Although the attendant can transform this device to a cot/stretcher position, one person will not be able to transfer such a patient without manual lifting.

Yet another problem with the '960 device is that the footrests cannot be elevated to the same height and parallel to the surface of the bed. For most total care patients, legs need to be elevated, and it is also difficult to transfer the patient when the legs are lower than the height of the bed and the bed is not adjustable.

Yet still another problem with the '960 device is that the chair does not have sufficient cushioning to the backrest or to the footrest. It is important to keep a disabled patient free from dermal ulcers caused by poor blood circulation. Currently, in nursing homes, it is routine to keep patients up for hours, seated in a wheelchair, before they can be put back to bed. Therefore, it is important that a backrest and a footrest have proper cushioning to avoid pressure buildup, limiting the circulation in particular areas of a patient's body.

Finally, the '960 device uses a detachable seat cushion. It is difficult to use a detachable seat cushion for a patient with bowel and bladder incontinence. Due to limited space availability in nursing homes and hospitals, it is inconvenient and difficult to store detachable cushions without mixing them with cushions which belong to other patients.

SUMMARY OF THE INVENTION

To overcome the limitations in the prior art described above, and to overcome other limitations that will become apparent upon reading and understanding the present specification, the present invention discloses a patient transfer device comprising a cushioned chair with wheels that facilitates patient transfer in and out of a hospital clinical bed. The present invention fulfills a need for a combination patient transfer device and wheelchair that provides an entirely different method of transferring patients that avoids lifting the total body weight of the patient and that provides the maximum comfort for the patient. This new patient transfer device is designed to be mobilized only by the caregiver; it is not to be mobilized by the occupant. Moreover, this new patient transfer device is less costly than most existing transfer devices. It is designed for easy and faster use by hospital staff and with good appearance, comfort and safety.

The present invention includes novel rear wheels that are designed to be below and within the dimension of the seats, which enables the patient transfer chair to fit flush to the bed when a patient is being transferred. The present invention is also designed for better mobility with undetachable wheels: two small cluster wheels for front and two larger wheels for rear.

The present invention includes novel armrests that detach from their normal position from the side of the chair when a patient is about to be transferred and attach to the backrest on the opposite side to prevent a patient from falling from the patient transfer chair when it is horizontally aligned with the bed.

The present invention includes an easily reclinable backrest to facilitate the transfer of a patient when the patient transfer chair is horizontally aligned with the surface of the bed. Cushions are covered with a material which has less friction than regular fabric, so that a patient may be moved slidingly in and out of a bed or a patient transfer chair by using a pull sheet of a draw sheet or a regular bed sheet. Some of these patients can be total care geriatrics, patients with fractures or post-surgery patients who need more requirements to facilitate transfer with ease than what presently exists. A patient does not have to be manually lifted using this method.

The present invention is designed to meet very specific needs when providing care for different types of patients.

For example, the present invention is designed to transfer a patient in and out of a hospital bed without having to lift the patient from the armpits, hands or legs to avoid bruising the skin, peeling off of skin or damaging bones, common problems when taking care of elderly patients with fragile skin and bones.

The present invention is designed for use with patients with hip fractures and spinal problems who may be moved from a chair to a bed without straining the patient's spine or back and allows the transfer of a patient while legs are separated by the abduction pillow, which is one of the most important requirements for patients after hip surgery, and it is a common problem with elderly patients in long term care.

The present invention is designed for use with patients with rib fractures to transfer them without straining the rib cage.

The present invention is designed for use with patients who are paralyzed and who need total care and patients who require long-term rehabilitation care after surgery.

The present invention includes footrests that assist patient transfer because they are designed to be aligned horizontally with the surface of the bed. The patient transfer chair can be adjusted to different positions to elevate a patient's legs when seated. It is designed with proper cushioning to protect and comfort a patient's legs below the knees.

The present invention gives maximum comfort to the disabled occupant of the patient transfer chair who is unable to move. It is designed with two to three inch thick cushioning for backrest, headrest, footrest and seat to alleviate the pressure from a patient's buttocks, back and legs, promoting better circulation for the seated patient.

The present invention includes cushion covers that are waterproof for patients who are incontinent; they are designed to be able to be washed with soap and water if necessary. All cushions are built in to avoid having unattached parts in the hospital environment.

The present invention is designed for best appearance. Unlike existing patient transfer devices, the present invention is provided with a light blue, black, white or gray frame with matching colors and designer type cushions and wheels.

The present invention includes a backrest that can be adjusted to different positions. The backrest can be adjusted parallel to the surface of a bed, and it can be aligned and attached to a bed by means of belting to secure patient transfer. Permanently mounted belt attachment mechanisms and belts similar to auto seat belts will be included.

The present invention enables fast and easy transfer of a patient to save time and energy and reduce work related injuries to care givers.

In summary, the present invention is designed to facilitate patient transfer by adapting an entirely different method, that is by drawing the patient from one surface to the other using a bed sheet or a draw sheet. Further objects and advantages of the present invention will become apparent from consideration of the following drawings and the ensuing descriptions.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
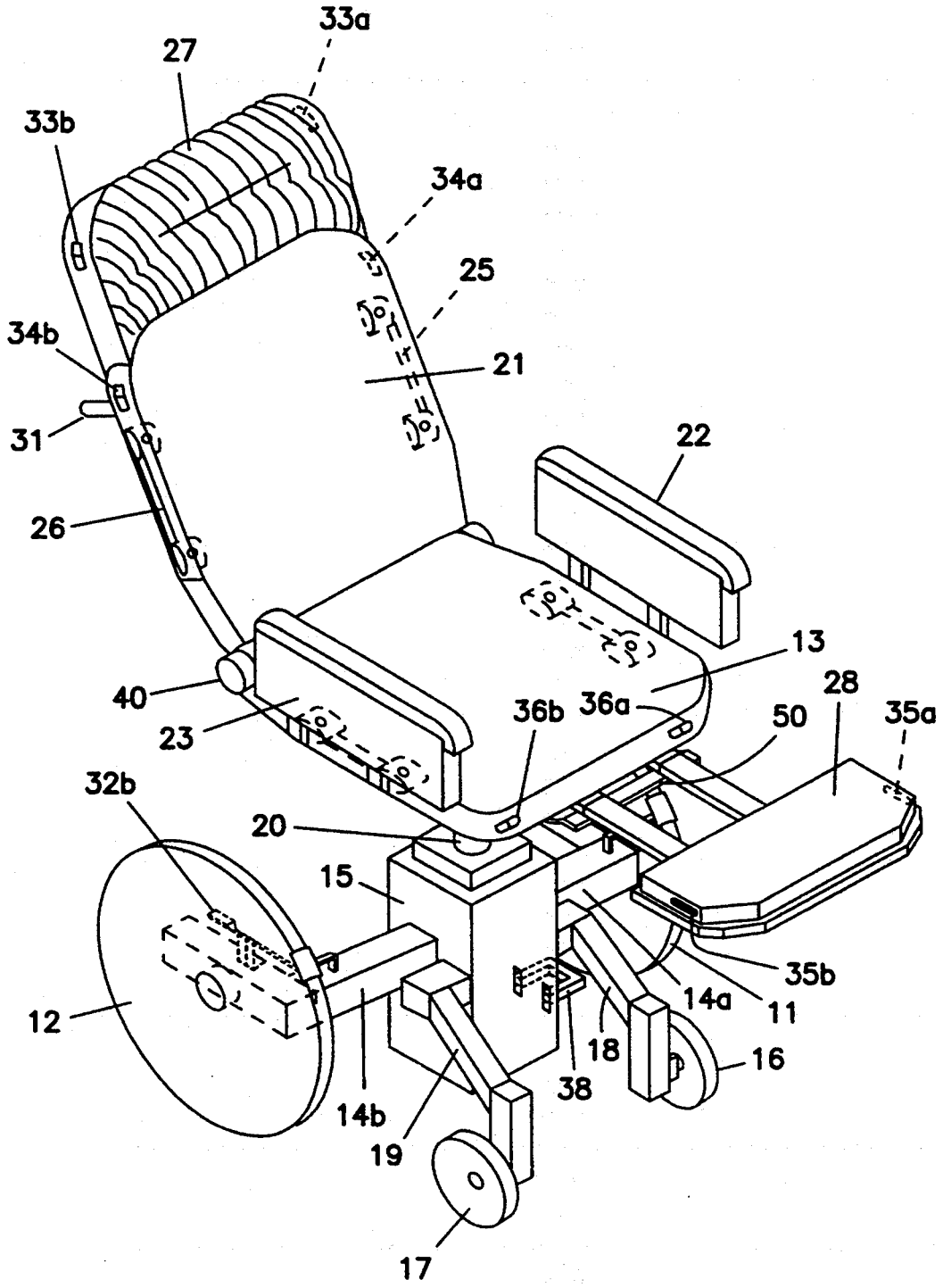
FIG. 1 is a perspective view of the present invention in its normal position as a chair.
Figure 2:
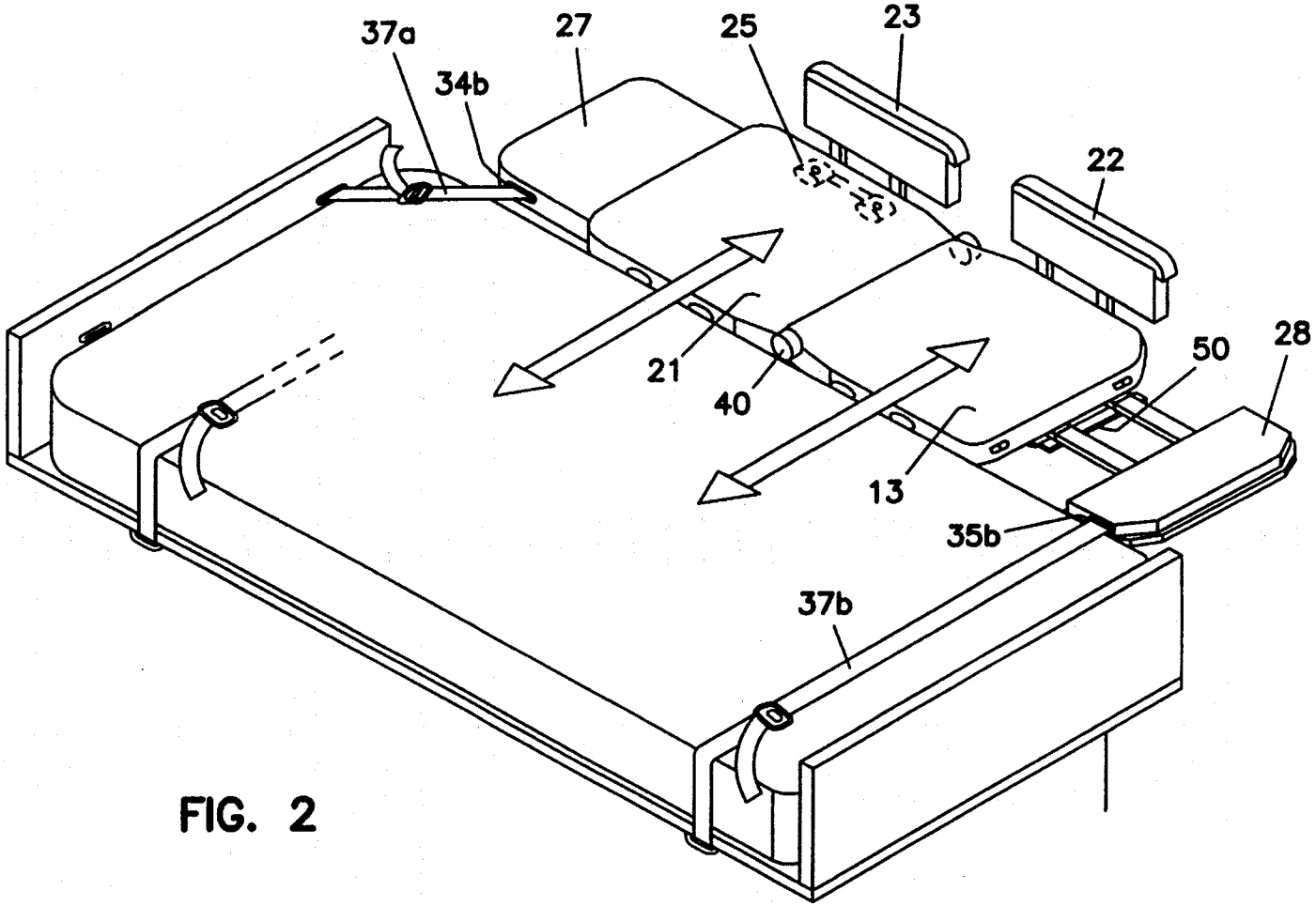
FIG. 2 is perspective view of the present invention in its patient transfer position.
Figure 3:
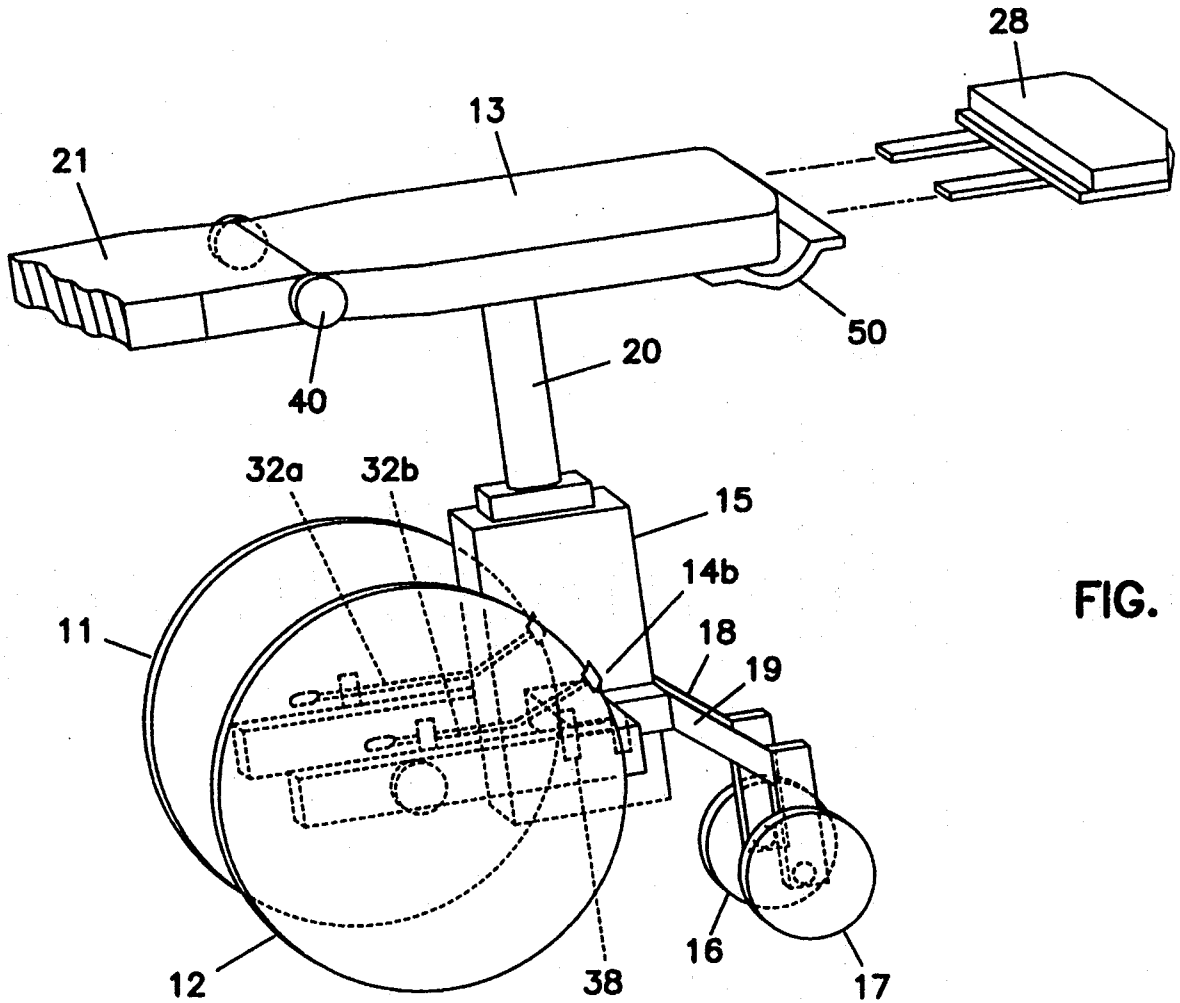
FIG. 3 is a view of the elevated shaft of the hydraulic pump with the patient transfer chair in its horizontally adjusted position.

The patient transfer chair of the present invention is shown in FIGS. 1, 2, and 3. FIG. 1 is a perspective view of the present invention in its normal position as a chair. FIG. 2 is a perspective view of the present invention in its patient transfer position. FIG. 3 is a view of the elevated shaft of the hydraulic pump with the patient transfer chair in its horizontally adjusted position.

COMPONENTS OF THE INVENTION

The basic frame of the device comprises, among other things, two large wheels, identified as left rear wheel 11 and right rear wheel 12, that are mounted below and within the width as the seat 13. The rear wheels 11 and 12 are mounted to left and right rear bars 14*a* and 14*b*. The left and right rear bars 14*a* and 14*b* are connected to a center base 15. Two small cluster wheels, identified as left front wheel 16 and right front wheel 17, are mounted to the left and right front bars 18 and 19. The left and right front bars 18 and 19 are connected to the center base 15. The center base 15 is suspended above the ground by all four wheels 11, 12, 16, and 17.

The center base 15 is mounted to a hydraulic pump 20 with a vertically elevating shaft directly mounted to the seat 13. The hydraulic pump 20 is actuated much in the same way as in a traditional barber chair in that a foot paddle 38 actuates the hydraulic pump 20.

A backrest 21 can be reclined to different positions and made completely horizontal to the surface of the bed.

Either left armrest 22 or right armrest 23 which is on the side next to the bed can be removed and attached to the armrest attachment mechanisms 25 and 26 on the opposite side of the patient transfer chair, as shown in FIG. 2. At this position, the armrests 22 and 23 will act similar to a bed railing to protect the patient from falling or sliding off the device.

The headrest 27, footrest 28, backrest 21 and seat 13 can be adjusted and aligned horizontally to the surface of the bed and attached to the bed to secure the patient transfer. The backrest 21 is adjusted by adjustment mechanism 40 and the footrest is adjusted by adjustment mechanism 50.

The handlebars 31 are for pushing the patient transfer chair.

The wheel brakes 32*a* and 32*b* are mounted on the large rear wheels 11 and 12, respectively.

The patient transfer chair also includes first belt attachment mechanisms 33*a* and 33*b* mounted on the headrest 27, second belt attachment mechanisms 34*a* and 34*b* mounted on the backrest 21, third belt attachment mechanisms 35*a* and 35*b* mounted on the footrest 28, and fourth belt attachment mechanisms 36*a* and 36*b*, are mounted on the seat 13. There are also external belt mechanisms 37*a* and 37*b*. The operation of these belt mechanisms will be discussed in more detail below.

OPERATION OF THE INVENTION

Patient transfer from a hospital bed to the patient transfer chair occurs in the following manner. The patient transfer chair is placed flush to the bed and the wheel brakes 32*a* and 32*b* are applied. The patient transfer chair is elevated to the level of the surface of the bed using the foot paddle 38 to actuate the hydraulic pump 20. The backrest 21 is reclined horizontally to the same level of the bed. The armrest 22 or 23 which is next to the bed is removed and attached to the armrest attachment mechanism or 26 on the backrest 21 side opposite to the side where the bed is located. At this position, the armrests 22 and 23 act as a bed railing to prevent the patient from falling or sliding from the one side as shown in FIG. 2. The patient transfer chair is attached to the bed by means of the belt attachment mechanisms 33, 34, 35, 36, and/or 37. By taking a good firm grip on the draw sheet or the bed sheet, the patient is slidingly drawn from the bed to the patient transfer chair. The patient transfer chair is lowered, and the seat 13, backrest 21, and armrest 22 or 23 are returned to their normal positions as shown in FIG. 1.

Patient transfer from the patient transfer chair to the hospital bed occurs in the following manner. The patient transfer chair is placed flush to the bed and the wheel brakes 32*a* and 32*b* are applied. Using the foot paddle 38 of the hydraulic pump 20, the patient is elevated in the patient transfer chair to the same level as the bed. The backrest 21 is reclined, and the footrest 28 is adjusted and elevated to the same level, so that both are horizontally aligned to the surface of the bed. The armrest 22 or 23 which is on the same side as the bed is removed and attached to the armrest attachment mechanism 25 or 26 on the backrest 21 side opposite to the side where the bed is located. The patient transfer chair is attached to the bed by means of belt attachment mechanisms 33, 34, 35, 36, 37, and/or 38 to secure the patient transfer as shown in FIG. 2. The patient may be slidingly drawn from the patient transfer chair to the bed by using the draw sheet or the bed sheet.

Note that the external belts 37*a* and 37*b* are similar to auto seat belts as shown in FIG. 2. The belts 37*a* and 37*b* use only two of the belt attachments simultaneously when attaching the patient transfer chair to the bed.

CONCLUSION, RAMIFICATIONS AND SCOPE OF THE INVENTION

Thus, the reader will see that the patient transfer chair of the present invention provides a very useful combination of a patient transfer device and a cushioned chair with wheels to use with hospital beds. The present invention provides for the safe, fast and easy transfer of patients with many types of restrictions and helps reduce or eliminate the lifting of patients by hospital workers.

While the above description contains many specificities, these are not to be construed as limitations on the scope of the invention, but rather as an amplification of one preferred embodiment thereof. Many variations are possible. For example, the present invention will be available in different sizes. In addition, the present invention could include a special footrest that can carry the legs of taller or heavier patients. Moreover, the hydraulic pump may be replaced by a mechanical or electro-mechanical lifting device.

I claim:

1. A patient transfer device to facilitate safe and easy patient transfer onto and out of a hospital bed, comprising:

a seat;

a backrest and a footrest, each with adjustment means for adjusting and aligning the backrest and footrest horizontally to the surface of the bed to facilitate patient transfer by slidingly drawing the patient onto and out of the bed to the patient transfer device;

removable armrests attached to the seat and armrest attachment mechanisms mounted on the backrest for attaching the armrests to the backrest, the armrests thereby providing a barrier to secure the patient during transfer between the patient transfer device and the bed;

a chair frame with a center base mounted on a pair of front wheels and a pair of rear wheels;

a hydraulic pump with a vertically displacing shaft mounted on the center base, the vertically displacing shaft being rigidly mounted to the underside of the seat of the chair, and the vertically displacing shaft being actuated for vertical elevation of the seat; and attachment means for attaching the patient transfer device to the bed.

2. A patient transfer device according to claim 1, further comprising a headrest attached to the backrest.

3. A patient transfer device according to claim 1, wherein the attachment means comprises belts and belt attachment mechanisms, wherein the belt attachment mechanisms are mounted on the backrest, headrest and seat.

4. A patient transfer device according to claim 1, further comprising means for reclining the backrest.

5. A method of patient transfer using a cushioned chair with wheels to facilitate safe and easy patient transfer onto and out of a hospital bed, wherein the cushioned chair comprises a chair frame with a center base mounted on a pair of front wheels and a pair of rear wheels, the method comprising the steps of:

horizontally adjusting and aligning a headrest, backrest, and footrest of the cushioned chair to the surface of the bed to facilitate patient transfer by slidingly drawing the patient onto and out of the bed to the cushioned chair;

removing one of two armrests from the cushioned chair and attaching the removed armrest to an armrest attachment mechanism mounted on the backrest, both the armrests thereby providing railings to secure the patient during transfer into the bed;

actuating a pump with a vertically displacing shaft mounted on the center base of the cushioned chair, wherein the shaft is rigidly mounted to a seat of the cushioned chair, thereby vertically elevating the seat of the cushioned chair to the surface of the bed to facilitate patient transfer by slidingly drawing the patient onto and out of the bed to the cushioned chair; and attaching the cushioned chair to the bed using attachment mechanisms when the chair is horizontally aligned to the surface of the bed, thereby securing the cushioned chair during transfer.

6. A patient transfer device to facilitate patient transfer into and out of a hospital bed, comprising:

a chair frame with a center base mounted on a pair of front wheels and a pair of rear wheels;

a seat attached to the center base of the chair frame;

means for vertically displacing a shaft mounted on the center base and attached to the seat, thereby vertically elevating the seat;

a backrest attached to the seat and having means for aligning the backrest to the surface of the bed;

first and second removable armrests attached to the seat of the device; and means for attaching one of the armrests to the backrest on a side opposite the bed, both of the armrests thereby providing railings to secure the patient during transfer into the bed.

7. A patient transfer device according to claim 6, further comprising a headrest attached to the backrest.

8. A patient transfer device according to claim 7, further comprising means for aligning the headrest to the surface of the bed to facilitate patient transfer.

9. A patient transfer device according to claim 6, further comprising a footrest attached to the seat.

10. A patient transfer device according to claim 9, further comprising means for aligning the footrest to the surface of the bed to facilitate patient transfer.

11. A patient transfer device according to claim 6, further comprising means for attaching the patient transfer device to the bed.

12. A patient transfer device according to claim 10, wherein the means for attaching comprises belts and belt attachment mechanisms.

13. A patient transfer device according to claim 6, wherein the backrest reclines.

* * * * *